United States Patent [19]

Partington

[11] 4,130,379

[45] Dec. 19, 1978

[54] MULTIPLE SIDE ENTRY ROOT FOR MULTIPLE BLADE GROUP

[75] Inventor: Albert J. Partington, Media, Pa.

[73] Assignee: Westinghouse Electric Corp., Pittsburgh, Pa.

[21] Appl. No.: 785,379

[22] Filed: Apr. 7, 1977

[51] Int. Cl.[2] ..... F01D 5/30

[52] U.S. Cl. ..... 416/193 A; 416/212 A; 416/219 R; 416/222

[58] Field of Search ..... 416/193 A, 222, 212 A, 416/219

[56] References Cited

U.S. PATENT DOCUMENTS

| | | | |
|---|---|---|---|
| 2,221,685 | 11/1940 | Smith | 416/191 |
| 2,272,831 | 2/1942 | Chalupa | 416/193 A X |
| 2,277,484 | 3/1942 | Flanders | 416/213 X |
| 2,773,169 | 12/1956 | Lees | 416/212 A X |
| 3,014,695 | 12/1961 | Rankin et al. | 416/191 |
| 3,108,782 | 10/1963 | Jannett | 416/212 A X |
| 3,597,109 | 8/1971 | Petrie et al. | 416/193 A X |
| 3,702,222 | 11/1972 | Bernales | 416/212 A |
| 3,741,681 | 6/1973 | DeWitt | 416/212 A X |

FOREIGN PATENT DOCUMENTS

| | | | |
|---|---|---|---|
| 731456 | 6/1955 | United Kingdom | 416/212 A |
| 813144 | 5/1959 | United Kingdom | 416/212 A |
| 918522 | 2/1963 | United Kingdom | 416/212 A |

*Primary Examiner*—Everette A. Powell, Jr.
*Attorney, Agent, or Firm*—J. W. Keen

[57] ABSTRACT

A multiple number of rotatable, axial flow turbine blades having a common platform and shroud portion from which two arcuately separated, axially extending, side entry roots protrude radially inwardly toward the axis of rotation of a rotatable shaft.

4 Claims, 2 Drawing Figures

MULTIPLE SIDE ENTRY ROOT FOR MULTIPLE BLADE GROUP

BACKGROUND OF THE INVENTION

This invention relates to rotatable turbine blades and more particularly to a group of turbine blades having common platform and shroud portions with multiple, side entry roots extending therefrom.

The control stage in many axial flow steam turbines utilizes pinned root, multiple blade units because of their higher rigidity and lower vibration susceptibility than single blade units which each have a separate root. The pinned root, multiple blade units have given better performance when exposed to vibratory excitation, but have resulted in high control stage assembly costs.

Some pinned root turbine blades have a radially outer point of fixity during blade vibration, which is relatively distant from the blade's platform portion. With such a relatively large distance between the point of fixity and the platform portion, the effective, unsupported blade length is increased causing low blade frequencies to be obtained which can result in vibratory resonance during partial admission operation. In addition, low blade frequencies cause vibration of the blades to decay slowly and thus have a greater tendency to resonate.

A number of multi-rooted and multi-bladed control stage groups have been known and used in the past. Typical of these is a design having two roots on each blade section with several of the blade sections being "tied together" into one blade group by securing a shroud on the radially outer end of the blades. Securing the shroud to the blades was often accomplished by riveting or deforming tenons protruding from the blades through the shroud.

Disadvantages of such a design include low frequency blades due to the close circumferential proximity of the roots on each blade section and the possible disproportionate loading of such roots if a blade becomes cocked due to the circumferential thermal expansion of the shroud. A further example of the designs previously alluded to include the subject of ASME paper number 61-WA122 which suggests brazing a number of blade sections together for the purpose of obtaining higher rigidity. This design, however, due to the relatively long blade group formed after brazing and the relatively widely spaced roots results in a relatively low excitation frequency during partial admission operation. In addition, brazing separate blade sections together presents the possibility of introducing flaws into the joints and having those flaws propagate onto cracks resulting in eventual separation during turbine operation. Such separation could cause long and expensive turbinegenerator forced outage.

A desirable control stage blade structure would have a low cost of assembly in the high pressure turbine section, high blade rigidity, and a sufficiently high blade frequency to prevent resonance during partial admission operation of the turbine.

SUMMARY OF THE INVENTION

In general, a turbine blading unit having high rigidity and high frequency response to vibratory excitation, when made in accordance with this invention, comprises a plurality of radially outwardly extending rotatable blades grouped together about a rotatable rotor along common platform and shroud portions of predetermined arcuate length from which two arcuately separated, axially extending side entry roots protrude radially inwardly and are engagable with the rotor. The blade unit's root construction allows the distance between the radially outer point of fixity and the platform portion to be minimized resulting in a high blade frequency. The root portions have at least one lug protruding therefrom for engagement with the rotatable rotor. The roots of the turbine blading unit are side entry which permit assembly costs for inserting the blading unit into a turbine to be minimized. Blading unit rigidity is maximized by forming the blading unit from a single workpiece.

BRIEF DESCRIPTION OF THE DRAWINGS

The objects and advantages of this invention will become more apparent from reading the following detailed description in connection with the accompanying drawings, in which.

DESCRIPTION OF THE PREFERRED EMBODIMENT

Figure 1:
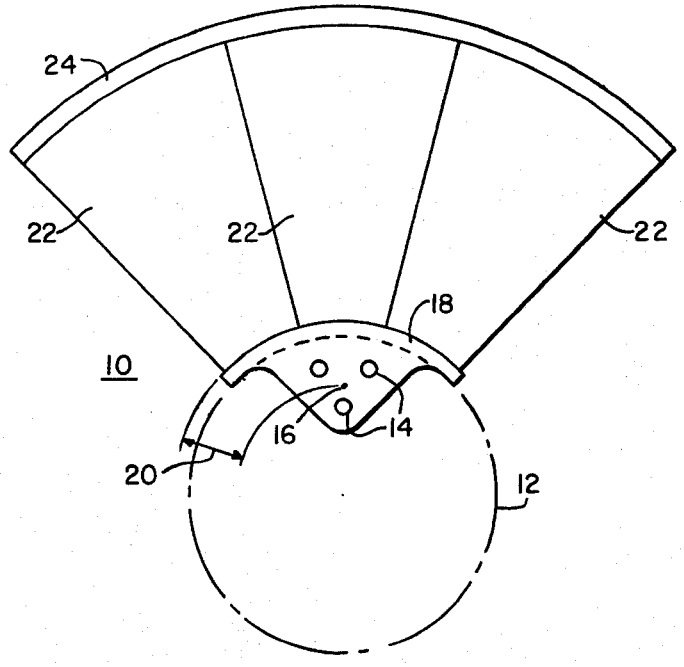
FIG. 1 is an elevation view of the prior art pinned root blade unit illustrated in its assembled position about a turbine rotor.

Referring now to the drawings in detail, FIG. 1 shows a pinned root turbine blading unit 10 assembled with rotatable rotor 12. Blade unit 10 is secured to rotor 12 by three axially extending pins 14 positioned in a triangular relationship. When blade unit 10 is subjected to tangential oscillations, it rotates about the point of fixity 16 located at the center of the pin formed triangle. The distance from blade unit 10's platform portion 18 to point of fixity 16 is designated as distance 20. Three rotatable blades 22 extend radially outwardly from common platform 18 and terminate at common shroud portion 24. Pinned root blading unit 10 is frequently formed from a single workpiece causing it to have a rigid structure and be less susceptible to vibratory excitation than individual blades which are assembled singly with rotor 12 or manufactured singly and subassembled with each other before being assembled with rotor 12.

Figure 2:
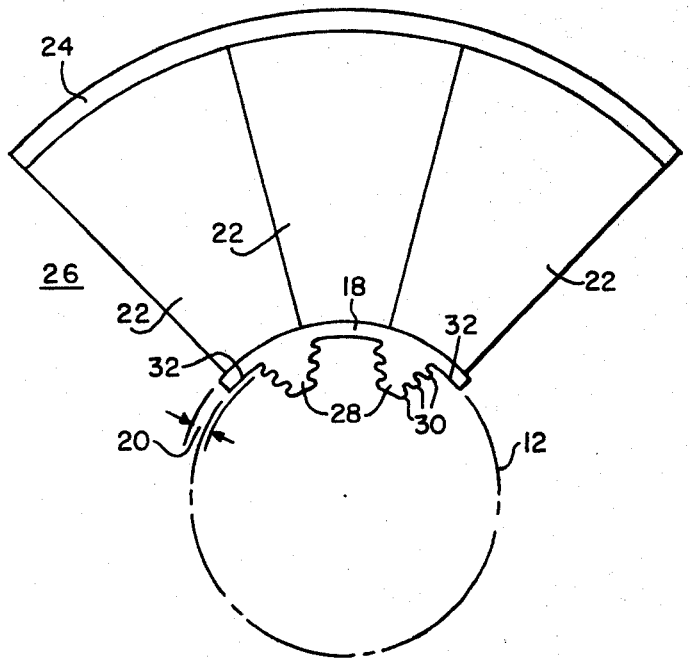
FIG. 2 is an elevation view of the present invention assembled with the turbine rotor.

FIG. 2 illustrates a side entry turbine blading unit 26 attached to rotor 12. Blading unit 26 has side entry roots 28 whose lugs 30 engage with and secure blading unit 26 with rotor 12. By use of side entry roots 28, distance 20 between platform 18 and the point of fixity can be minimized since the point of fixity is along the radially outer lug 30 of side entry roots 28.

During partial admission operation of a turbine having shaft 12 extending therethrough, elastic fluid is allowed to enter the turbine blade path through predetermined arcuate distances about the circumference of the blades at one axial end of the turbine. Partial admission is most often used for turbine start-up, shut-down, and part load operation. Thus, as rotor 12 rotates, the blades attached thereto on the control stage are periodically exposed to the entering, elastic fluid which subject those blades to a shock loading and consequent vibration. High blade frequencies have been shown to be desirable in minimizing vibration. To increase blade frequency, it is necessary to decrease the effective unsupported blade length. Blade length from the radially outer boundary platform portion 18 to the radially inner boundary of shroud portion 24 is one component of effective, unsupported blade length and is set by permissible elastic fluid volumetric flow rates and pressure drop restrictions in the axial direction across those blades. A second component of effective, unsupported blade length is distance 20 which is disposed between the radially outer boundary platform 18 and the radially outer point of fixity. Minimizing distance 20 also minimizes the effective unsupported length of blades 22 which results in higher blade frequencies and better performance when those blades are exposed to shock loading such as from the previously mentioned partial admission operation. Higher blade frequencies allow the blade to respond better when vibratorily excited by causing the blade's vibration to decay faster and have less tendency to resonate.

To assemble the pinned root turbine blading unit 10, it is necessary to simultaneously drill root holes and rotor holes so that they are in general alignment and are capable of receiving pins 14. To firmly secure blading unit 10 to shaft 12 it has been necessary to develop a very tight fit between blade and rotor receiving holes and pins 14. To accomplish this, pins 14 must be cooled below ambient temperature causing the pins to shrink in diameter before they are inserted through the pinned root and engaging rotor 12. The present invention, however, requires no simultaneous manufacturing operations on blade unit 26 and rotor 12 nor any cooling operations on the roots of blading unit 26. Blade unit 26 can be assembled with rotor 12 by axially sliding unit 26 into suitable openings cut therein and then using standard locking devices at the crown portions of rotor extensions 32. A typical standard locking device is a pin which is assembled in a circumferential groove formed on mating blade platform 18 and disc extensions.

While this invention has been shown as having three rotatable blades grouped together in blading unit 26, it is to be understood that other numbers of blades 22 can be grouped together to accomplish the same objectives. Additionally while the side entry roots 28 have been shown as each embodying three lugs, any number of lugs may be used to withstand the centrifugal forces exerted on the blading unit.

The illustrated embodiment utilizes two fir tree side entry roots for the purpose of precluding blade unit rotation about a single root when three or more roots are used.

It will now be apparent that an improved blading unit has been provided in which a side entry root structure is utilized so as to minimize blade frequency by minimizing effective, unsupported blade lengths. The multiple membered, side entry root structure on the multiple membered blade unit also enables assembly costs with turbine rotors to be reduced.

I claim:

1. An integral turbine blading unit which is disposed about a rotatable rotor, said blading unit comprising:

three radially outwardly extending rotatable blades grouped together in a single axial row along a common platform portion of predetermined arcuate length from which two arcuately separated, axially extending side entry roots protrude radially inwardly and are engagable with said rotor causing said blading unit to have high rigidity and high frequency resulting in low response to vibratory excitation.

2. The turbine blading unit of claim 1, further comprising:

a common shroud disposed at the radially outer end of said plurality of rotatable blades.

3. The turbine blading unit of claim 1, wherein said roots have, when viewed from an axial end, a fir tree shape with at least one lug protruding from the sides of said shape, said lug being interlockable with said rotor causing said blading unit to be securable thereto.

4. The turbine blading unit of claim 3, wherein said lugs are disposed a minimum radial distance from the radially inner ends of said rotatable blades causing said high blade frequency.

* * * * *